US012116850B1

(12) United States Patent
McCormick

(10) Patent No.: US 12,116,850 B1
(45) Date of Patent: Oct. 15, 2024

(54) DEVICE FOR CENTERING A SENSOR ASSEMBLY IN A BORE

(71) Applicant: PETROMAC IP LIMITED, Auckland (NZ)

(72) Inventor: Stephen Peter McCormick, Auckland (NZ)

(73) Assignee: PETROMAC IP LIMITED, Auckland (NZ)

( * ) Notice: Subject to any disclaimer, the term of this patent is extended or adjusted under 35 U.S.C. 154(b) by 0 days.

(21) Appl. No.: 18/509,497

(22) Filed: Nov. 15, 2023

(51) Int. Cl.
*E21B 17/10* (2006.01)

(52) U.S. Cl.
CPC ..... *E21B 17/1028* (2013.01); *E21B 17/10* (2013.01); *E21B 17/1021* (2013.01); *E21B 17/1078* (2013.01)

(58) Field of Classification Search
CPC .. E21B 17/1028; E21B 17/10; E21B 17/1021; E21B 17/1078
See application file for complete search history.

(56) References Cited

U.S. PATENT DOCUMENTS 3,395,758 A * 8/1968 Kelly ..... E21B 43/14 166/100
3,474,541 A * 10/1969 Cubberly, Jr. ..... E21B 47/08 33/544.3
3,555,689 A * 1/1971 Cubberly, Jr. ..... E21B 47/08 166/241.5
3,749,168 A * 7/1973 Hall, Sr. ..... E21B 17/1028 166/241.7
4,425,966 A * 1/1984 Garney ..... G01V 11/005 166/241.5
4,506,219 A * 3/1985 Lee ..... E21B 47/08 175/325.2
11,371,296 B2 6/2022 McCormick
2007/0181298 A1 8/2007 Sheiretov et al.
2012/0055711 A1* 3/2012 Brannigan ..... E21B 47/08 175/50
2016/0298396 A1* 10/2016 Church ..... E21B 17/1021
2018/0003027 A1* 1/2018 Donzier ..... E21B 47/10
2018/0078998 A1* 3/2018 Sherman ..... B22F 1/062
2021/0270092 A1* 9/2021 Buckland ..... E21B 17/1028
2022/0162917 A1* 5/2022 Flander ..... E21B 17/1028

FOREIGN PATENT DOCUMENTS

WO WO-2016014571 A1 * 1/2016 ..... B32B 27/08

* cited by examiner

*Primary Examiner* — Tara Schimpf
*Assistant Examiner* — Neel Girish Patel
(74) *Attorney, Agent, or Firm* — DANN DORFMAN HERRELL and SKILLMAN, P.C.

(57) ABSTRACT

A device for centering a sensor assembly in a bore has three or more bow-spring assemblies spaced circumferentially apart around a longitudinal axis of the device and pivotally attached between first and second support members. Each bow-spring assembly comprises two or more bow-springs stacked together in a bow-spring stack, with each bow-spring in the bow-spring stack extending between first and second pivot members pivotally attached to the first and second support members.

17 Claims, 6 Drawing Sheets

DEVICE FOR CENTERING A SENSOR ASSEMBLY IN A BORE

CORRESPONDING APPLICATION

This application is based on the provisional specification filed in relation to New Zealand Patent Application Number 802673, the entire contents of which is incorporated herein by reference.

TECHNICAL FIELD

This invention relates to devices for use in centering sensor equipment down a bore such as a pipe, a wellbore or a cased wellbore, and in particular to devices for use in centering sensor equipment in wireline logging applications.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string. A wireline logging tool-string is typically in the order of 20 ft to 100 ft long and 2" to 5" in diameter.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. The measurement from these sensors is optimised with good centralisation in the wellbore.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. The logging tool is lowered by the wireline cable down the wellbore under the force of gravity alone. The cable, being flexible, cannot push the tool down the wellbore. Hence the operator at the top of the well has very little control of the descent of the logging tool.

The chances of a wireline logging tools failing to descend is significantly increased with deviated wells. Deviated wells do not run vertically downwards and instead extend downward and laterally at an angle from vertical. Multiple deviated wells are usually drilled from a single surface location to allow a large area to be explored and produced. As wireline logging tools are run down a wellbore with a cable under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1, in deviated wells the weight of the tool-string exerts a lateral force (PW) perpendicular to the wellbore wall. This lateral force results in a drag force which acts to prevent the tool-string descending the wellbore. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

As hole deviation increases, the sliding friction or drag force can prevent the logging tool descending. The practical limit is 60° from the vertical, and in these high angle wells any device that can reduce friction is very valuable. The drag force is the product of the lateral component of tool weight acting perpendicular to the wellbore wall and the coefficient of friction. It is desirable to reduce the coefficient of friction to reduce the drag force.

A common apparatus to centralise logging tools is a bow-spring centraliser. Bow-spring centralisers incorporate a number of curved bow springs. The bow springs are attached at their extremities to an attachment structure that is fixed to the logging tool. The midpoint of the curved bow spring (or bow) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are flattened, and the flattened bow springs provide a centering force on the tool string. In deviated wells this centering force must be greater than the lateral weight component of the tool string acting perpendicular to the wellbore or casing wall. Consequently, more centering force is required at greater well deviations. If the centering force is too small the centraliser will collapse, and the tool sensors are not centered. If the centralising force is too great the excessive force will induce unwanted drag which may prevent the tool descending or cause stick-slip motion of the logging tool. Stick-slip is where the tool moves up the wellbore in a series of spurts rather than at a constant velocity. Stick-slip action will compromise or possibly invalidate the acquired measurement data. The practical limit for gravity decent with using bow spring centralisers is in the order of 60 degrees from the vertical. Wellbores are vertical at shallow depths and build deviation with depth. Consequently, the centralisation force that is necessary varies within the same wellbore. As the bow spring centraliser must be configured for the highest deviations, invariably there is more drag than what is necessary over much of the surveyed interval.

With bow spring centralisers, the centralising force is greater in small diameter wellbores, as the bow springs have greater deflection (more compressed), than in large diameter wellbores. Consequently, any given bow spring centraliser presents a higher drag in smaller bores than in larger bores across a bore-diameter operating range.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for centering sensor equipment in a bore or pipe.

According to one aspect of the present invention there is provided a device for centering a sensor assembly in a bore, the device comprising:

- a first support member and a second support member axially spaced apart along a central longitudinal axis of the device, one or both of the first and second support members configured to move axially along the central longitudinal axis,
- three or more bow-spring assemblies spaced circumferentially apart around a longitudinal axis of the device, each bow-spring assembly pivotally attached between the first and second support members, wherein each bow-spring assembly comprises:
  - a first pivot member pivotally attached to the first support member,
  - a second pivot member pivotally attached to the second support member, and
  - two or more bow-springs stacked together in a bow-spring stack, each bow-spring in the bow-spring stack extending between the first and second pivot members.

In some embodiments, the bow spring-stack is coupled to each of the first and second pivot members to allow axial relative movement between the two or more bow-springs at the first and second pivot members.

In some embodiments, in each bow-spring assembly:

- the two or more bow springs in the bow-spring stack comprises a fixed bow-spring and one or more unfixed bow-springs, wherein
- the fixed bow-spring is fixed to the first and second pivot members to prevent relative movement between ends of the fixed bow-spring and the first and second pivot members, and
- each end of the one or more unfixed bow-springs is mounted to a respective said first or second pivot member to allow relative axial movement therebetween In some embodiments, the fixed bow-spring is an outermost bow-spring in the bow-spring stack, and the one or more unfixed bow springs is one or more inner bow-springs stacked radially inside the outermost fixed bow-spring.

In some embodiments, each of the first and second pivot members and/or each end of the fixed bow-spring comprises a pocket to receive an end of the one or more unfixed bow-springs to allow for axial movement of the ends of the one or more unfixed bow-springs therein.

In some embodiments, the pocket constrains movement of or captures the ends of the one or more unfixed bow-spring (s) in a lateral direction of the bow-spring stack.

In some embodiments, the pocket constrains movement of or captures the ends of the one or more unfixed bow-spring (s) in a radial direction of the bow-spring stack.

In some embodiments, the respective first and second pivot members and the fixed bow-spring together form the pocket for receiving an end of the one or more unfixed bow-springs to move axially or slide therein In some embodiments, in each bow-spring assembly:

- the two or more bow-springs in the bow-spring stack are fixed together at an axial center region of the bow-spring stack to prevent relative movement therebetween at the center region.

In some embodiments, each bow-spring assembly comprises a wear member fixed to an outer radial surface of the bow-spring stack at an axial center region of the bow-spring assembly to contact a wall of the bore in use.

In some embodiments, the device comprises fasteners to fasten the wear pad to the bow-spring stack and fix the two or more bow-springs in the bow-spring stack together at the axial center region of the bow-spring stack to prevent relative movement therebetween at the center region.

In some embodiments, the wear member comprises one or more rivets to extend through the stack of bow-springs to fix the wear member to the bow-spring stack and fix the two or more bow-springs in the bow-spring stack together at the axial center region to prevent relative movement therebetween at the center region.

In some embodiments, the bow-spring stack comprises only two said bow-springs, an inner bow-spring and an outer bow-spring.

In some embodiments, the device has an undeflected outer diameter with the bow-spring assemblies in an undeflected configuration, and wherein the undeflected outer diameter is greater than a maximum bore diameter of a known desired bore operating range so that the device provides a required minimum centering force at the maximum bore diameter.

In some embodiments, the device is configured to provide a minimum centering force at a maximum bore diameter of a known desired bore operating range, and the two or more bow-springs in the bow-spring stack each have a thickness that is less than a thickness of a single bow-spring required to achieve the required minimum centering force at the maximum bore diameter. In other words, the two or more bow-springs in the bow-spring stack each have a thickness such that the device provides a required minimum centering force at a maximum bore diameter of a known desired bore operating range, and the thickness of each of the two or more bow-springs is less than a thickness of a single bow-spring required to achieve the required minimum centering force at the maximum bore diameter.

In some embodiments, the device is configured to provide a minimum centering force at a maximum bore diameter of a known desired bore operating range, and wherein the stack of bow-springs has a spring constant that is lower than a spring constant of a single bow-spring required to achieve the minimum centering force at the maximum bore diameter According to a second aspect of the present invention there is provided a method for manufacturing the device according to the first aspect of the invention. The method comprises:

selecting a thickness of each of the two or more bow-springs and an undeflected outside diameter for the device to achieve a required minimum centering force at a maximum bore diameter of a known desired bore operating range, the undeflected outside diameter greater than the maximum bore diameter, wherein the thickness of the two or more bow-springs is less than a thickness of a single bow-spring required to achieve the required minimum centering force at the maximum bore diameter.

In some embodiments, the method comprises selecting a width and length of the two or more bow-springs, the undeflected outside diameter corresponding with the length.

According to a third aspect of the present invention there is provided a wireline logging tool string comprising one or more elongate sensor assemblies and one or more devices according to the first aspect of the invention described above for centering the wireline logging tool string in a wellbore during a wireline logging operation.

Unless the context suggests otherwise, the term "wellbore" may to refer to both cased and uncased wellbores. Thus, the term 'wellbore wall' may refer to the wall of a wellbore or the wall of a casing within a wellbore.

Unless the context suggests otherwise, the term "tool string" refers to an elongate sensor package or assembly also known in the industry as a "logging tool" and may include components other than sensors such as guide and orientation devices and carriage devices attached to sensor components or assemblies of the tool string. A tool string may include a single elongate sensor assembly, or two or more sensor assemblies connected together.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

In FIG. 2 the centraliser is illustrated with bow-springs of the centraliser at a maximum outside diameter of the centraliser.

FIG. 6 is an isometric view, FIG. 7 is a side view and FIG. 8 is an end view.

FIG. 9 is an isometric view, FIG. 10 is a side view and FIG. 11 is an end view.

FIGS. 12A and 12B are isometric views and FIG. 12C is a side view. In FIG. 12A an outer radial surface of the bow-spring assembly is visible, and in FIG. 12B an inner radial surface of the bow-spring assembly is visible.

BEST MODES FOR CARRYING OUT THE INVENTION

Figure 1:
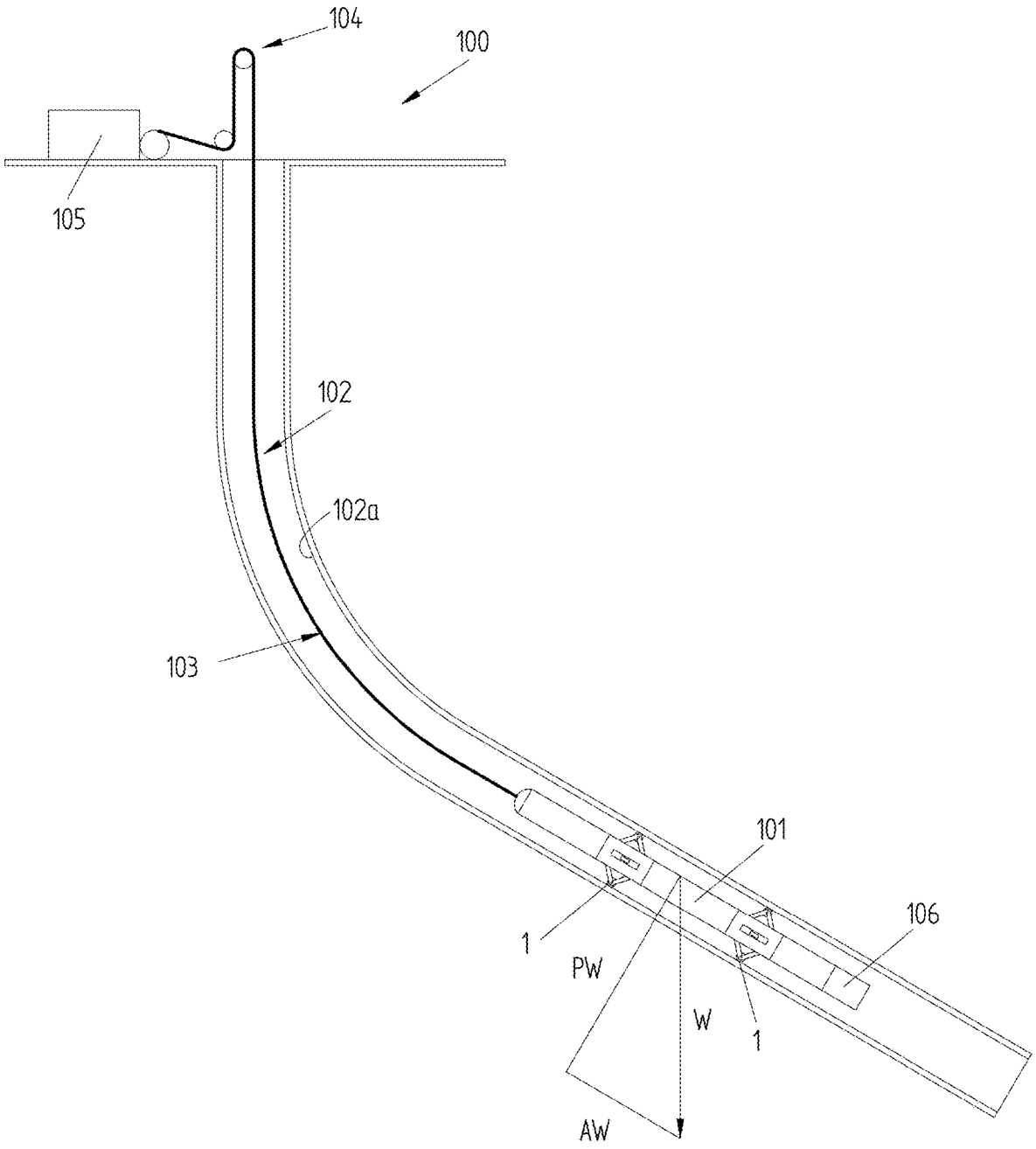
FIG. 1 is a schematic representation of a well site and a tool string descending a wellbore in a wireline logging operation.
Figure 2:
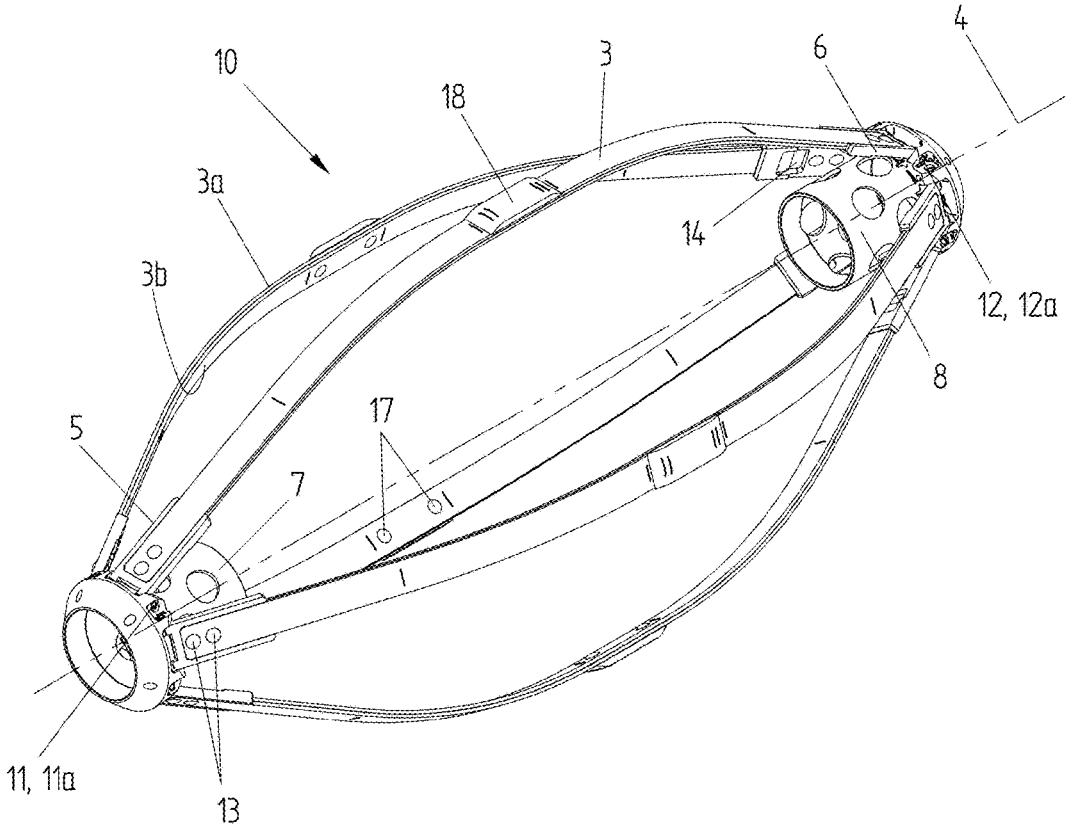
FIG. 2 is an isometric view of a centraliser according to one example of the present invention.
Figure 3:
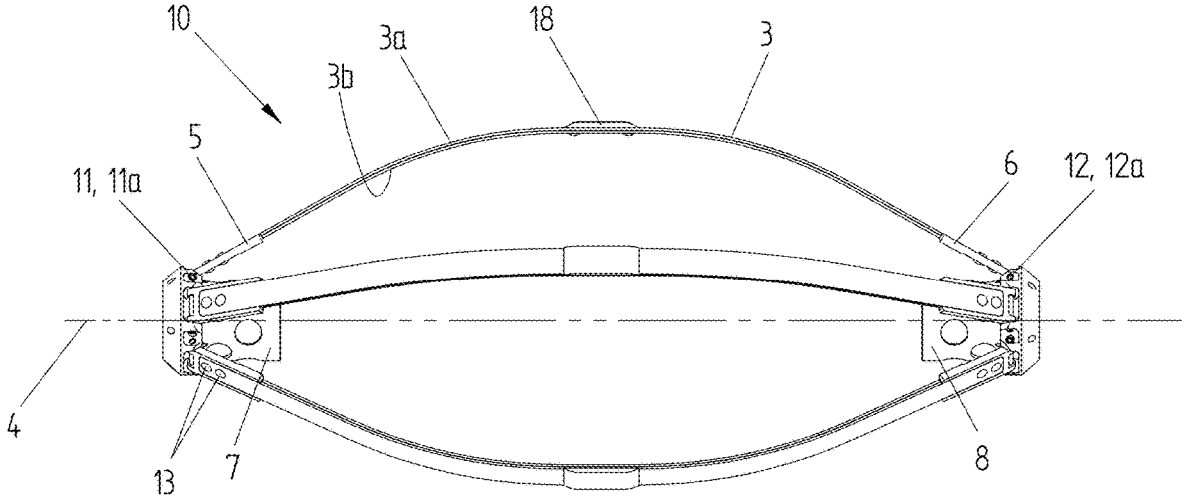
FIG. 3 is a side view of the centraliser of FIG. 2 with the bow-springs at the maximum OD of the centraliser.
Figure 4:
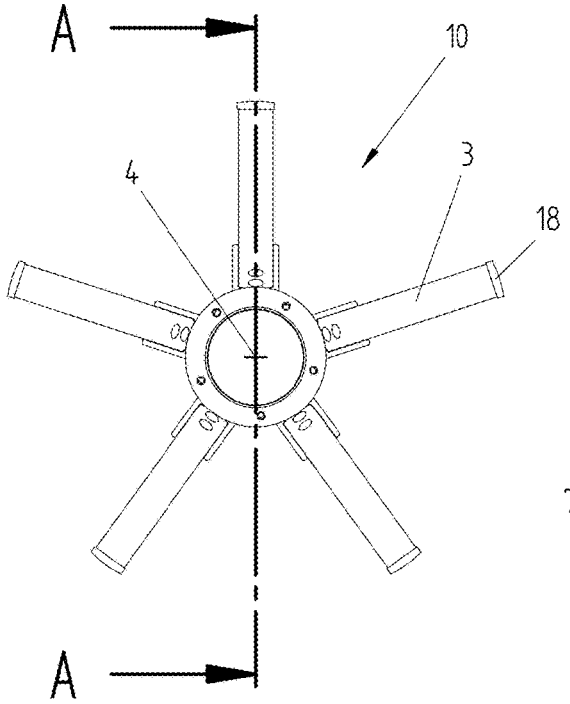
FIG. 4 is an end view of the centraliser of FIG. 2 with the bow-springs at the maximum OD of the centraliser.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more logging tools each carrying one or more sensors 106 coupled together to form the logging tool string 101. The wireline 103 includes a number of wires or cables to provide electrical power to the one or more sensors 106 and transmit sensor data to the wellsite surface. One or more centralising devices 1 are provided to the logging tool 101 to centralise the logging tool 101 in the wellbore 102.

FIGS. 2 to 11 illustrate a centralising device 10 to be provided with or as part of the tool string 101. The centralising device (or centraliser) comprises a plurality of bow-spring assemblies 3 spaced circumferentially apart around a longitudinal axis 4 of the device 10. The illustrated embodiment comprises five bow-spring assemblies 3, however, one skilled in the art will appreciate a centraliser 10 according to the present invention may have three, four, five, six or more bow-spring assemblies, each bow-spring assembly 3 as described herein.

The centraliser comprises a first support member 7 and a second support member 8, with the plurality of bow-spring assemblies 3 pivotally connected between the first and second support members. One or both of the support members 7, 8 are configured to move axially along the longitudinal axis 4 of the device 10 to cause the plurality of bow-spring assemblies 3 to move radially to engage the wellbore wall by pivoting at the first and second support members 7, 8 as the first and/or second support member moves axially.

One or both support members 7, 8 may slide axially on a central member or mandrel of the centraliser (not shown) or on a body of the tool string 101. The support members 7, 8 may comprise a collar or annular member colinear with the longitudinal axis of the device 10. The collar or annular member is received on the mandrel or tool string in use to slide thereon. The longitudinal axis 4 of the device 10 is colinear with the longitudinal axis of the tool string in use so that the bow-springs 3 act against the wellbore wall to centralise the tool string within the bore. The support members 7, 8 may be keyed to the mandrel or tool string tool body so that the support members move axially without relative rotation between the support members and the mandrel/tool string.

Figure 12A:
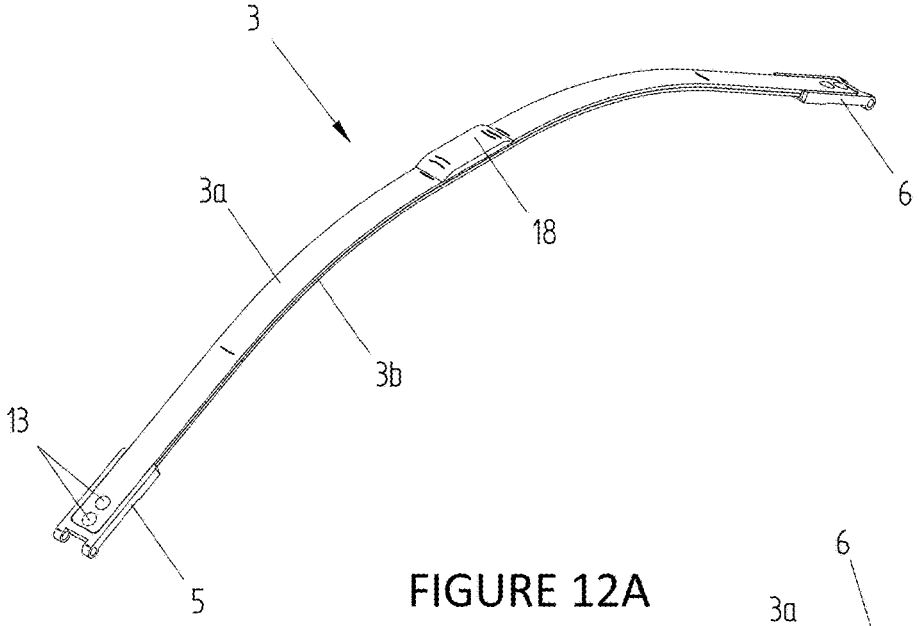
FIGS. 12A to 12C illustrate one bow-spring assembly of the centraliser of FIG. 2.
Figure 12B:
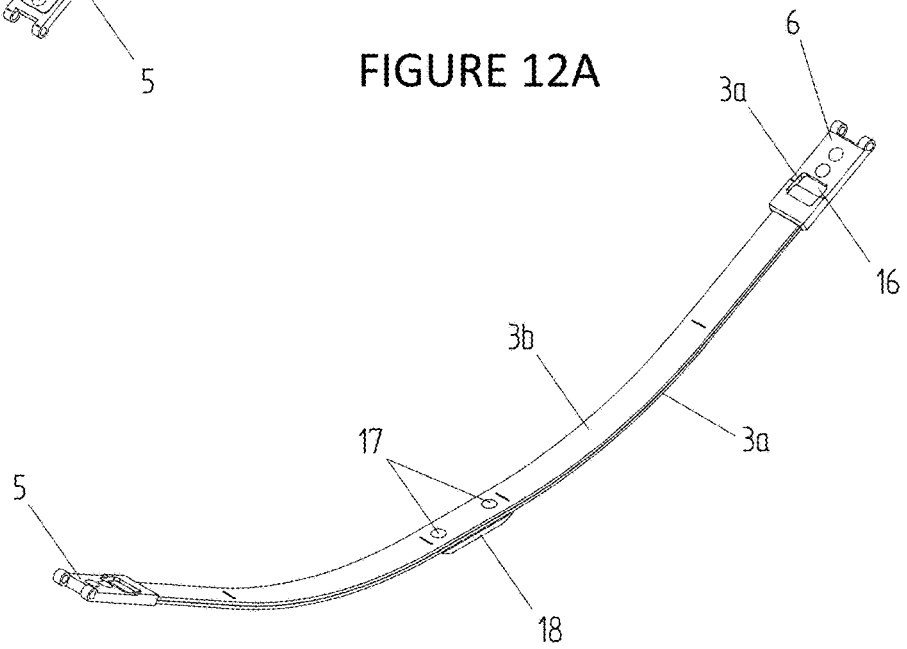
Figure 12C:
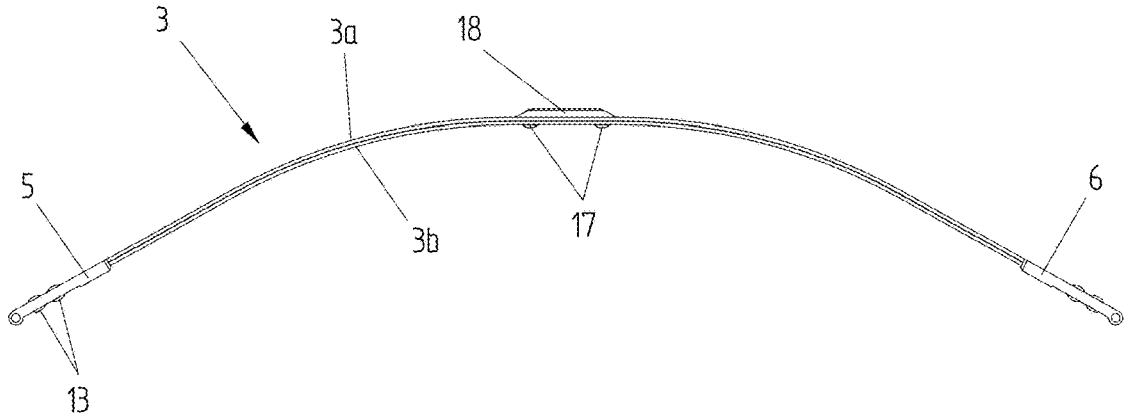

An individual bow spring assembly 3 is illustrated in FIGS. 12A to 12C. The bow-spring assembly 3 comprises a stack of bow-springs 3*a*, 3*b* extending between a first pivot member 5 and a second pivot member 6. With reference to FIGS. 2 to 5, the first pivot member 5 is pivotally attached to the first support member 7 and the second pivot member 6 is pivotally attached to the second pivot member 8. The first pivot member 5 pivotally attaches the bow-spring assembly 3 to the first support member 7 via a first pivot joint 11 having a first pivot axis 11*a*, and the second pivot member pivotally attaches the bow-spring assembly to the second support member via a second pivot joint 12 having a second pivot axis 12*a*. In the illustrated embodiment and as best shown in FIGS. 5 and 12A to 12C, each pivot member 5, 6 comprises a hole for receiving a pivot pin therethrough. The pivot pin is received through a hole in the corresponding support 7, 8 to pivotally couple the spring assembly 3 to the respective support 7, 8. Each pivot joint 11, 12 comprises the pivot pin received through the respective holes in the pivot member 5, 6 and support 7, 8. However, other pivot joint arrangements may be provided, for example each pivot member 5, 6 may comprise spigots received in holes or recesses in the corresponding support 7, 8 or vice versa.

The bow-spring stack comprises two or more bow-springs 3*a*, 3*b* stacked together, i.e. an inner radial facing surface of an outer bow spring 3*a* is stacked on an outer radial facing surface of an adjacent inner bow spring 3*b*. The bow springs are stacked together in a radial direction of the device, such that the radial height or thickness of the bow-spring stack is equal to the sum of the thickness of the individual bow-springs in the stack. The illustrated embodiment comprises two bow-springs 3*a*, 3*b* in the bow-spring stack, however, one skilled in the art will appreciate that a centraliser 10 according to the present invention may have bow-spring assemblies 3 with two, three, four or more bow-springs in each bow-spring stack. Each bow-spring 3*a*, 3*b* in the stack of bow-springs extends (fully) between the first pivot member 5 and the second pivot member 6, i.e. each end of each bow-spring in the bow-spring stack is coupled to a respective said first or second pivot member. The bow springs in the bow-spring stack are in contact along the length of the bow springs between the first and second pivot members. The inner bow spring(s) is/are in contact and support the outer bow spring along the full length of the outer bow spring extending between the pivot members 5, 6.

The two or more bow-springs 3*a*, 3*b* in each stack are permanently formed into a bow shape, as best illustrated in FIG. 12C. Therefore, each bow-spring assembly 3 exerts a radially outward force when the bow-spring stack is pressed radially inwards towards a flat configuration (see FIGS. 9 to 11). The radial outward force therefore increases for a decreasing wellbore diameter.

Figure 6:
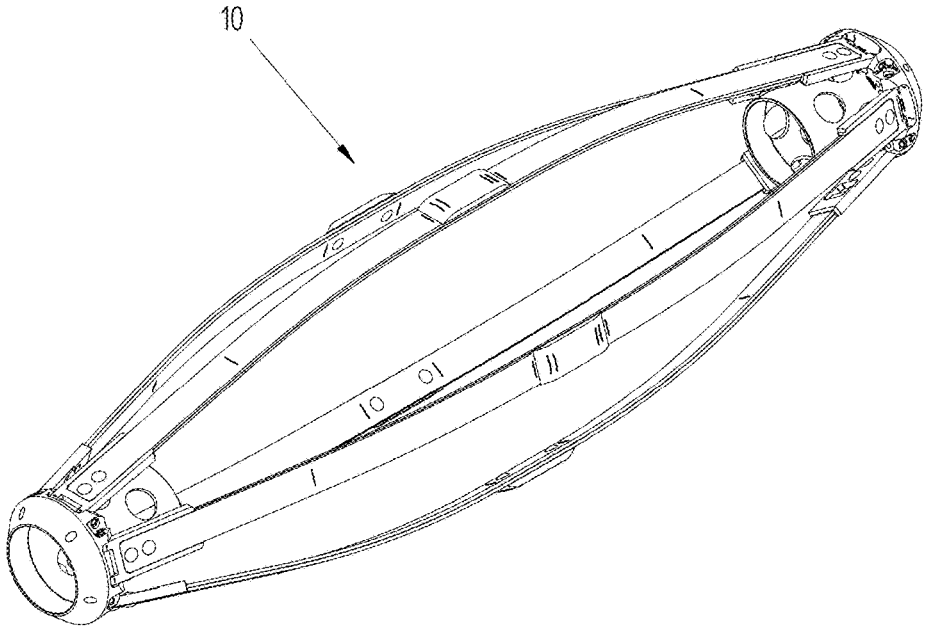
FIGS. 6 to 8 illustrate the centraliser of FIG. 2 but with the bow-springs of the centraliser pressed inwards to an OD smaller than the maximum OD of the centraliser.
Figure 7:
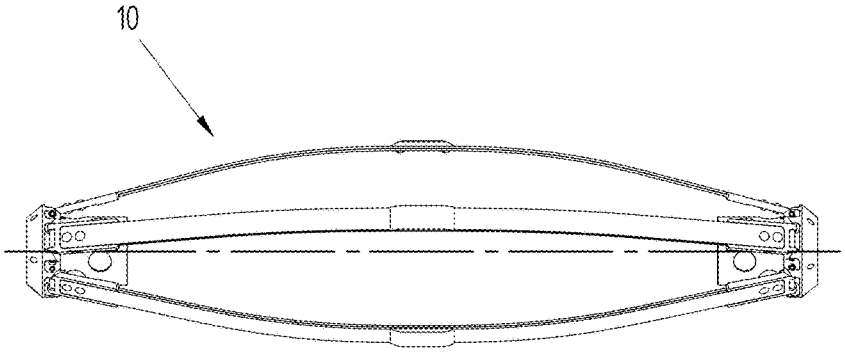
Figure 8:
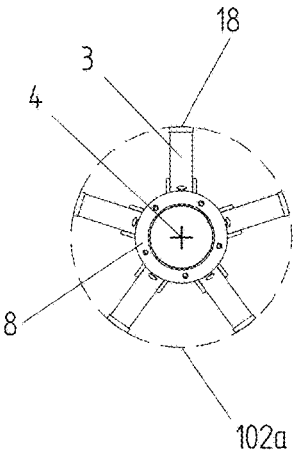
Figure 9:
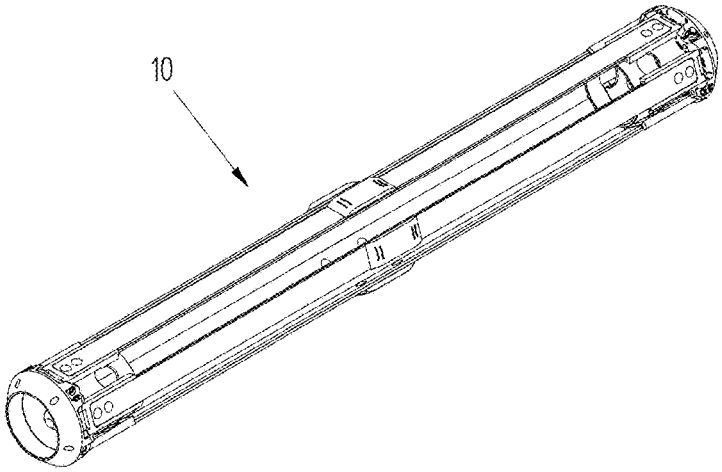
FIGS. 9 to 11 illustrate the centraliser of FIG. 2 but with the bow-springs of the centraliser pressed inwards to a minimum OD of the centraliser.
Figure 10:
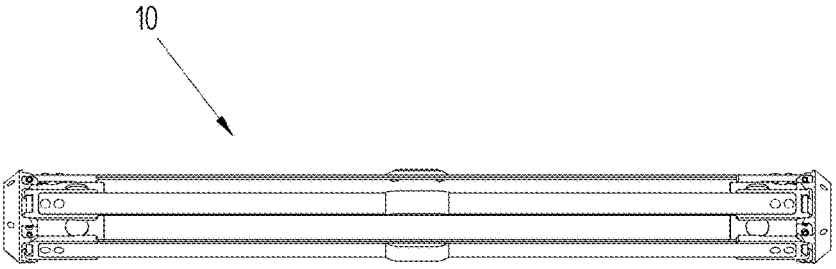
Figure 11:
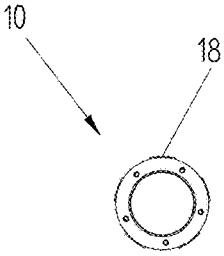

The axial distance between the support members 7, 8 increases as the bow springs are pressed inwards from a maximum OD configuration as shown in FIGS. 2 to 5 towards a flat configuration (or minimum OD configuration) shown in FIGS. 9 to 11. FIGS. 6 to 8 illustrate the device 10 in an intermediate configuration, with the OD of the centraliser intermediate between the maximum OD and the minimum OD configurations. FIG. 8 illustrates the device 10 in the intermediate position within a wellbore 102 (indicated by dashed line-type) with the bow-spring assemblies 3 acting radially outwards against the bore wall to hold the centraliser 10 centrally in the bore.

As described above, each bow-spring 3*a*, 3*b* in the bow-spring stack extends between the first pivot member 5 and the second pivot member 6 (i.e. from the first pivot member to the second pivot member). The bow spring-stack 3*a*, 3*b* is coupled to the first and second pivot members 5, 6, to allow axial relative movement between the two or more bows-springs at the first and second pivot members. The bow spring-stack 3*a*, 3*b* is coupled to the first and second pivot members 5, 6, to allow axial relative movement between the two or more bows-springs at each end of the bow spring stack. In the illustrated embodiment, one of the bow-springs in the bow-spring stack is a fixed bow-spring. The fixed bow-spring is fixed to the first and second pivot members to prevent relative movement between the ends of the fixed bow-spring 3*a* and the first and second pivot members 5, 6. The other bow-spring(s) 3*b* in the bow-spring stack is/are 'unfixed' bow-springs. Thus, each bow-spring stack comprises one fixed bow-spring and one or more unfixed bow-springs with respect to ends of the bow springs and the respective first and second pivot members 5, 6. Each end of the one or more unfixed bow-springs is mounted to the respective first or second pivot member to allow for axial movement of the end of the unfixed bow-spring relative to the pivot members 5, 6 and therefore the fixed bow spring 3*a*. In the illustrated embodiment, the unfixed bow-spring 3*b* in the bow-spring stack is coupled to the first and second pivot members 5, 6 to allow for axial movement relative to the first and second pivot members 5, 6 and therefore the fixed bow spring 3*a*. The coupling of the bow-spring stack at each of the first and second pivot members 5, 6 allows for axial (sliding) movement between the bow springs at each of the first and second pivot members. The axial movement or axial sliding movement is in a longitudinal direction of the respective bow-spring in the bow-spring stack indicated by the double-ended arrow in FIG. 5. While the example device has two bow-springs in each bow-spring stack—a fixed bow-spring and an unfixed bow spring with respect to the first and second pivot members, one skilled in the art will understand there may be one fixed bow spring and two or more unfixed bow-springs in each stack.

In the illustrated embodiment, an outer most bow-spring 3*a* in the bow-spring stack is fixed to the first and second pivot members 5, 6 to prevent relative movement between the fixed outermost bow-spring and the first and second pivot members. An inner bow-spring 3*b* is coupled to the first and second pivot members 5, 6 to allow axial movement between the inner bow-spring 3*b* and the first and second pivot members (or end of the fixed bow-spring 3*a*). In alternative embodiments there may be two or more inner bow-springs 3*b* each coupled to the first and second pivot members to move axially relative to the first and second pivot members (or end of the fixed bow-spring 3*a*). A person skilled in the art will appreciate that alternative embodiments may comprise a fixed inner bow-spring 3*b* fixed to the first and second pivot members 5, 6 and one or more outer bow-springs coupled to the first and second pivot members 5, 6 to allow axial movement between the one or more outer bow-springs 3*a* and the first and second pivot members (or end of the fixed inner bow-spring 3*b*), or a fixed bow-spring intermediate the stack of bow-springs with inner and outer bow-springs coupled to the first and second supports to axially move relative to the first and second pivot members.

In the illustrated embodiment the fixed bow-spring 3*a* is fixed to the first and second pivot members 5, 6 by rivets 13. However, other fixing means may be provided, such as threaded fasteners, welding, or the fixed bow-spring and first and/or second pivot members may be integrally formed.

Each pivot member 5, 6 and/or the fixed bow-spring 3*a* may comprise a pocket (14, FIGS. 5 and 12B) to receive an end of the one or more unfixed bow-springs 3*b* in the stack of bow-springs to allow for axial movement of the unfixed bow-spring(s) therein. The pocket 14 receives an end of the unfixed bow spring(s) to constrain movement of or capture the unfixed bow-spring(s) to the pivot member in a lateral direction of the bow-spring stack, perpendicular to the longitudinal direction of the bow-spring yet allow axial movement of the unfixed bow-springs in the longitudinal direction.

Figure 5:
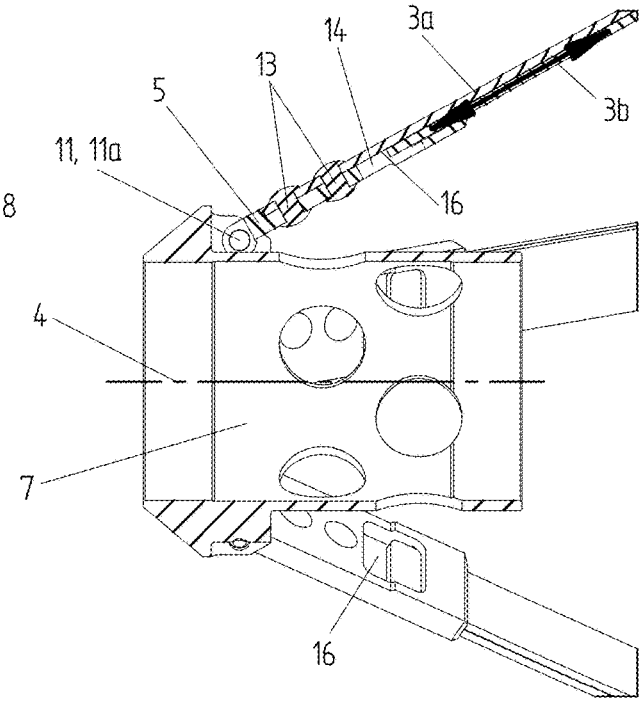
FIG. 5 is a part sectional view on line A-A in FIG. 4 showing a support member and ends of bow-spring assemblies pivotally connected to the support member.
Figure 13:
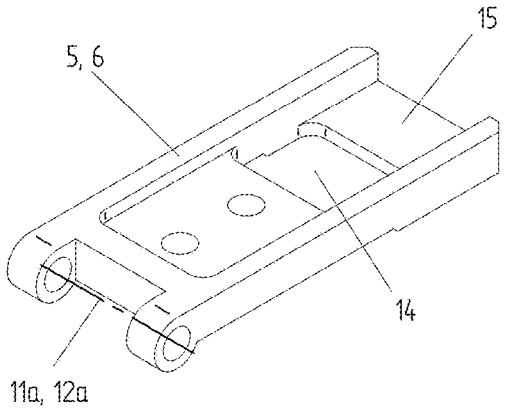
FIG. 13 is an isometric view of a pivot member of the bow-spring assembly of the centraliser of FIG. 2.

In the illustrated embodiment, and with reference to FIG. 5, the pivot member 5, 6 and fixed bow-spring 3*a* together form the pocket 14 for receiving an end of the unfixed bow-spring 3*b* to move axially or slide therein. The fixed bow-spring 3*a* provides a radially inward facing surface (16, FIGS. 5 and 12B) to capture the unfixed bow-spring in an outward radial direction. The pivot member 5, 6 provides a radially outward facing surface (15, FIG. 13) with the unfixed bow-spring captured between the opposed radial facing surfaces 15, 16. Thus, the pocket 14 captures the unfixed bow-spring in the lateral and radial directions yet allows for relative axial movement.

In some embodiments the bow-springs in the bow-spring stack are fixed together at an axial center (center region) of the bow-spring stack, i.e. at or near to a midpoint between the first and second pivot axes 11*a*, 12*a*. The fixing at the center region prevents relative movement between the bow-springs at the axial center. The center (19, FIG. 14) or center region of the bow-spring stack located at the axial centre of the bow-spring assembly may have a length of about 10% of the total distance between the pivot axes of the bow-spring assembly when deflected to the 'flat' configuration.

Figure 14:
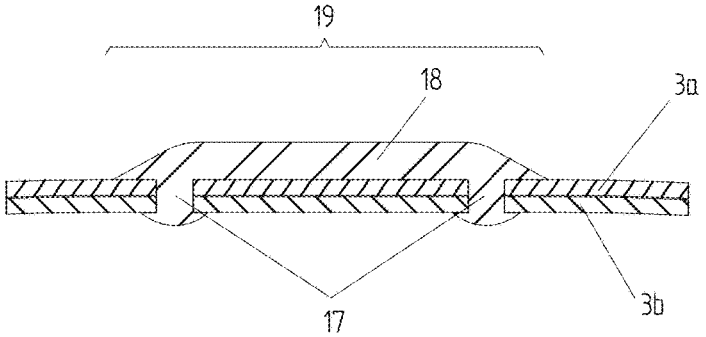
FIG. 14 is a part sectional view on line A-A in FIG. 4 showing a center region of a bow-spring assembly of the centraliser.

In the illustrated embodiment, the bow-springs are fixed together by a pair of rivets 17, as shown in FIG. 14, however other fastening means, such as threaded fasteners, or the bow-springs 3*a*, 3*b* may be welded together at the centre region. Again, with reference to the example embodiment, the rivets 17 may be provided together as part of a single unitary body. Each bow-spring assembly may comprise a wear pad or member 18. The wear pad is fixed at the outer radial surface of the bow-spring stack at the axial center of the bow-spring stack. The wear member is located at the center or center region of the bow-spring stack to contact the wellbore wall to reduce wear of the bow-spring stack. In the illustrated embodiment, the rivets 17 are integrally formed with the wear member 18 and extend through the stack of bow-springs to fix the individual bow-springs 3*a*, 3*b* together. The wear member may provide one or more rivets, but preferably at least two. Alternatively, separate rivets may extend through the wear pad and bow-springs to fix the wear pad and springs together at the centre of the springs.

A bow spring stack allows for individual bow-springs within the stack to have less thickness compared to a required thickness when using a single bow-spring to achieve a necessary radial force required to support the weight of a tool string at the centre of the bore. Having a stack of thinner bow-springs allows a lower spring constant (N/mm) to provide a greater deflection for a given radial force without permanent deformation (without exceeding yield stress) compared to a thicker single bow-spring. A lower spring constant provides for a 'flatter' or more constant spring characteristic, and therefore allows for an increased centering force at larger bore diameters and a reduced centering force at smaller bore diameters for a given bore diameter operating range compared to device comprising bow-spring assemblies each with a single bow-spring.

Figure 15:
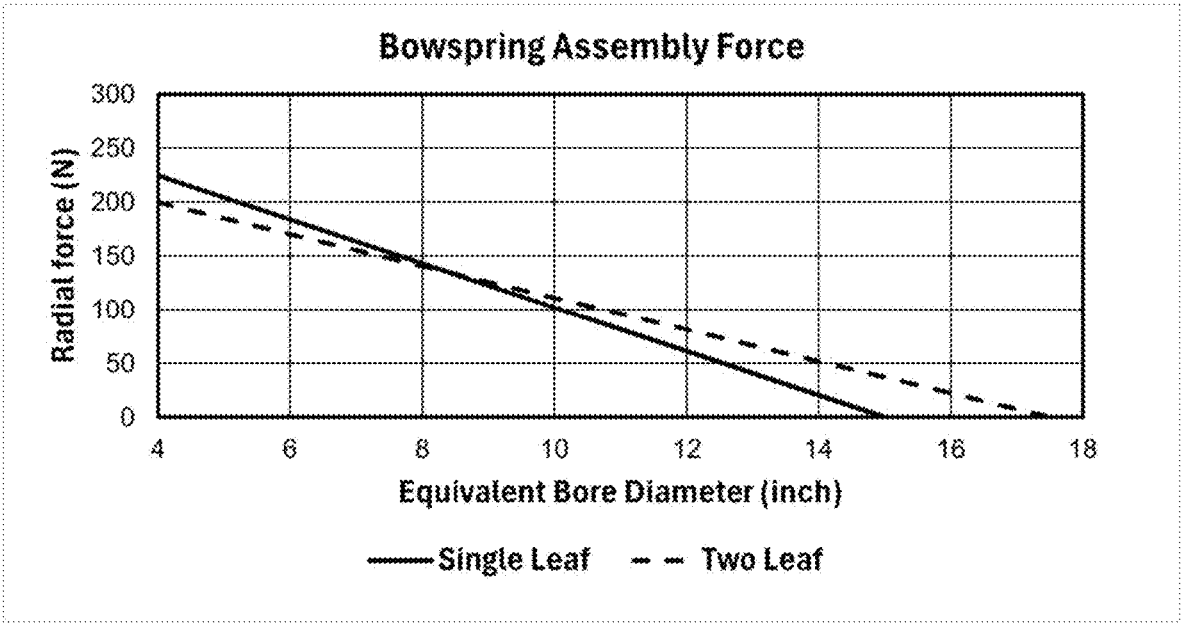
FIG. 15 is a graph showing the radial force generated from a single individual bow-spring compared to that of a bow-spring stack comprising two bow-springs stacked together.

FIG. 15 illustrates a comparison of example characteristics of a single bow-spring and a bow-spring assembly comprising two bow-springs in a stack for an example desired wellbore diameter operating range of 6 inches to 12 inches. The bow-spring assembly 3 with two bow-springs 3*a*, 3*b* provides a larger centering force in the larger 12" bore size and a lower centering force in the smaller bore 6" size compared to the single bow-spring. As described above, the stack of bow-springs has a lower spring rate and therefore achieves a 'flatter' or more constant spring characteristic over the desired operating range. The invention may be applied to other diameter design ranges, the range of 6 to 12 inches provided by way of example.

A desired force characteristic may be achieved by forming the bow springs 3*a*, 3*b* with a curve so that the centraliser 10 has an undeflected outside diameter that is greater than a maximum internal diameter of a desired wellbore operating range. The undeflected outer diameter of the device is when the bow-springs are undeflected, i.e. with the device at its 'free length'. For example, FIGS. 1 to 4 show the centraliser 10 with the bow-spring assemblies undeflected and therefore in the undeflected outside diameter configuration. In FIGS. 6 to 8 the centraliser may be at a maximum bore ID for a desired operating bore diameter range.

As shown in FIG. 15, the bow-spring stack comprising two bow-springs stacked together results in a centraliser outside diameter of 17.5 inches when undeflected (zero radial force). This provides a required minimum centering force of about 80 pounds when deflected to an outside diameter of 12 inches—the maximum operational bore ID of 12 inches in the desired range of 6 to 12 inches. And as described above, the lower spring constant compared to the single bow spring results in a lower force at the minimum operational bore ID of 6 inches compared to the single bow-spring and therefore provides for a centraliser with less drag in smaller bore sizes.

By example, parameters for the bow-spring characteristics illustrated in FIG. 15 are listed below:

- Single bow bow-spring: width 1.2"×thickness 0.125"×flat length pivot to pivot 31" with an equivalent bore size of approx. 15.2" when undeflected, material Young's modulus 200 GN/mm$^2$.
- Two-bow bow-spring: width 0.875"×thickness 0.1"×flat length pivot to pivot 31" with an equivalent bore size of approx. 17.5" when undeflected, material Young's modulus 200 GN/mm$^2$.

A centraliser according to one or more aspects of the present invention as described above provides for one or more of the following benefits. A centraliser with bow-spring assemblies comprising a bow-spring stack can be configured to provide a lower spring constant to provide a lower centering force in smaller bores to reduce drag in smaller bores while also providing sufficient centering force in larger bore sizes to ensure the tool string is supported in the center of the bore. Alternatively, to achieve a desired centering support force, two or more bow-springs may be stacked together to achieve a higher or greater spring constant (N/mm). Hence, a centraliser with three or more bow-spring assemblies spaced circumferentially apart around the central axis each comprising a bow-spring stack of two or more bow-springs may be configured to carry more load at a given bore ID compared to an equivalent centraliser with three or more individual bow-springs spaced circumferentially apart around the central axis. A stack of bow-springs in each bow-spring assembly also provides for some redundancy and is more resistant to wear. Should one bow-spring in a stack of bow-springs fail, one or more other bow-springs in the stack are present to continue to support the sensor assembly in the bore. The thickness of each bow-spring in a stack of bow-springs is less than the thickness of an individual bow-spring providing the same stiffness for a given bore size, yet the stack of bow-springs provides a greater overall thickness, thereby providing more resistance to wear. For example, two bow-springs each 25 mm wide and with a 1.6 mm thickness is equivalent in stiffness at a given bore diameter to a single bow-spring with a width of 25 mm and a 2.03 mm thickness. Removal of one 1.6 mm bow-spring from the stack of two bow-springs reduces the stiffness of the bow-spring assembly by 50%, whereas for the 2.03 mm thick single bow-spring, only a 0.4 mm reduction in thickness results in a 50% reduction in stiffness. In this example, the bow-spring stack comprising two bow-springs is thus 4 times more resistant to wear compared to an equivalent single bow-spring. Further, the greater overall thickness of a stack of bow-springs compared to a single thicker bow-spring providing an equivalent stiffness at a given bore size provides greater torsional and lateral bending strength to resist lateral loading of bow-springs which may be significant in difficult operating conditions.

The invention has been described with reference to centering a tool string in a wellbore during a wireline logging operation. However, a centralising device according to the present invention may be used for centering a sensor assembly in a bore in other applications, for example to center a camera in a pipe for inspection purposes.

Although this invention has been described by way of example and with reference to possible embodiments thereof, it is to be understood that modifications or improvements may be made thereto without departing from the spirit or scope of the appended claims.

| | |
|---|---|
| 3 Bow spring assembly | 11 First pivot joint, 11a First pivot axis |
| 3a Outer bow | 12 Second pivot joint, 12a Second pivot axis |
| 3b Inner bow | 13 Rivets |
| 4 Central axis | 14 pocket |
| 5 first pivot member | 15 radial outward facing surface |
| 6 second pivot member | 16 radial inward facing surface |
| 7 First support member | 17 rivets |
| 8 Second support member | 18 wear plate |
| 10 Centraliser | 19 Axial center of bow-spring assembly |

The invention claimed is:

1. A device for centering a sensor assembly in a bore, the device comprising:

a first support member and a second support member axially spaced apart along a central longitudinal axis of the device, one or both of the first and second support members configured to move axially along the central longitudinal axis, three or more bow-spring assemblies spaced circumferentially apart around a longitudinal axis of the device, each bow-spring assembly pivotally attached between the first and second support members, wherein each bow-spring assembly comprises:

a first pivot member pivotally attached to the first support member, a second pivot member pivotally attached to the second support member, and two or more bow-springs stacked together in a bow-spring stack, each bow-spring in the bow-spring stack extending between the first and second pivot members, wherein the bow-spring stack is coupled to each of the first and second pivot members to allow axial relative movement between the two or more bow-springs from one another at the first and second pivot members.

2. The device as claimed in claim 1, wherein in each bow-spring assembly:

the two or more bow springs in the bow-spring stack comprises a fixed bow-spring and one or more unfixed bow-springs, wherein each end of the fixed bow-spring is fixed to a respective said first or second pivot member to prevent relative movement between the end of the fixed bow-spring and the respective first or second pivot member, and each end of the one or more unfixed bow-springs is mounted to a respective said first or second pivot member to allow relative axial movement between the end of the unfixed bow-spring and the respective first or second pivot member.

3. The device as claimed in claim 2, wherein the fixed bow-spring is an outermost bow-spring in the bow-spring stack, and the one or more unfixed bow springs is one or more inner bow-springs stacked radially inside the outermost fixed bow-spring.

4. The device as claimed in claim 2, wherein each of the first and second pivot members and/or each end of the fixed bow-spring comprises a pocket to receive an end of the one or more unfixed bow-springs to allow for the axial movement of the ends of the one or more unfixed bow-springs therein.

5. The device as claimed in claim 4, wherein the pocket constrains movement of or captures the ends of the one or more unfixed bow-spring(s) in a lateral direction.

6. The device as claimed in claim 4, wherein the pocket constrains movement of or captures the ends of the one or more unfixed bow-spring(s) in a radial direction of the bow-spring stack.

7. The device as claimed in claim 4, wherein the respective first and second pivot members and the fixed bow-spring together form the pocket for receiving an end of the one or more unfixed bow-springs to move axially or slide therein.

8. The device as claimed in claim 2, wherein the fixed bow-spring is an innermost bow-spring in the bow-spring stack, and the one or more of the unfixed bow-springs is one or more outer bow-springs stacked radially outside the innermost fixed bow-spring.

9. The device as claimed in claim 1, wherein in each bow-spring assembly:

the two or more bow-springs in the bow-spring stack are fixed together at an axial center region of the bow-spring stack to prevent relative movement therebetween at the center region.

10. The device as claimed in claim 1, wherein each bow-spring assembly comprises a wear member fixed to an outer radial surface of the bow-spring stack at an axial center region of the bow-spring assembly to contact a wall of the bore in use.

11. The device as claimed in claim 10, wherein the device comprises fasteners to fasten the wear member to the bow-spring stack and fix the two or more bow-springs in the bow-spring stack together at the axial center region of the bow-spring stack to prevent relative movement therebetween at the center region.

12. The device as claimed in claim 10, wherein the wear member comprises one or more rivets to extend through the stack of bow-springs to fix the wear member to the bow-spring stack and fix the two or more bow-springs in the bow-spring stack together at the axial center region to prevent relative movement therebetween at the center region.

13. The device as claimed in claim 1, wherein the bow-spring stack comprises only two said bow-springs, an inner bow-spring and an outer bow-spring.

14. The device as claimed in claim 1, wherein the device has an undeflected outer diameter with the bow-spring assemblies in an undeflected configuration, and wherein the undeflected outer diameter is greater than a maximum bore diameter of a known desired bore operating range so that the device provides a required minimum centering force at the maximum bore diameter.

15. The device as claimed in claim 1, wherein the device is configured to provide a minimum centering force at a maximum bore diameter of a known desired bore operating range, and wherein the two or more bow-springs in the bow-spring stack each have a thickness that is less than a thickness of a single bow-spring required to achieve the required minimum centering force at the maximum bore diameter.

16. The device as claimed in claim 1, wherein the device is configured to provide a minimum centering force at a maximum bore diameter of a known desired bore operating range, and wherein the stack of bow-springs has a spring constant that is lower than a spring constant of a single bow-spring required to achieve the minimum centering force at the maximum bore diameter.

17. A method for manufacturing the device as claimed in claim 1, the method comprising:

selecting a thickness of each of the two or more bow-springs and an undeflected outside diameter for the device to achieve a required minimum centering force at a maximum bore diameter of a known desired bore operating range, the undeflected outside diameter greater than the maximum bore diameter, wherein the thickness of each the two or more bow-springs is less than a thickness of a single bow-spring required to achieve the minimum centering force at the maximum bore diameter.

* * * * *